US005580227A

United States Patent [19]

Rappenhoner

[11] Patent Number: 5,580,227

[45] Date of Patent: Dec. 3, 1996

[54] ROTARY PISTON PUMP HAVING SYNCHROUSLY DRIVEN DIVIDING SLIDES AND DOSING DEVICE

[76] Inventor: Hans R. Rappenhöner, Lindenallee 6, Lindlar, Germany, D-51789

[21] Appl. No.: 244,982

[22] Filed: Aug. 29, 1994

[30] Foreign Application Priority Data

Dec. 20, 1991 [DE] Germany ..... 9115838 U

[51] Int. Cl.[6] ..... F04C 2/356; F04C 15/02

[52] U.S. Cl. ..... 418/23; 418/46; 418/245; 417/900; 222/291

[58] Field of Search ..... 418/23, 46, 113, 418/159, 245; 417/900; 222/291, 305

[56] References Cited

U.S. PATENT DOCUMENTS

| | | | |
|---|---|---|---|
| 892,351 | 6/1908 | Beaubien . | |
| 935,489 | 9/1909 | Garrabrant et al. . | |
| 996,272 | 6/1911 | McMillan . | |
| 1,001,533 | 8/1911 | Kinney | 418/46 |
| 1,248,518 | 12/1917 | MacKinnon | 418/113 |
| 1,261,128 | 4/1918 | Higgins | 418/245 |
| 2,023,608 | 12/1935 | Nebel | 418/46 |
| 2,796,030 | 6/1957 | Nebel | 418/245 |
| 3,988,083 | 10/1976 | Shimizu et al. | 418/264 |
| 4,123,205 | 10/1978 | Peleschka et al. | 418/127 |
| 4,187,064 | 2/1980 | Wheeler | 418/245 |

FOREIGN PATENT DOCUMENTS

| | | | |
|---|---|---|---|
| 0065591 | 12/1982 | European Pat. Off. . | |
| 62-265485 | 11/1987 | Japan | 418/245 |
| 834657 | 5/1960 | United Kingdom | 418/23 |

*Primary Examiner*—John J. Vrablik
*Attorney, Agent, or Firm*—Jones & Askew

[57] ABSTRACT

The present invention relates to a rotary piston pump for conveying and/or metering liquid or pourable media. It consists of a pump casing (2) with a cylinder chamber (4) having a cylindrical inner periphery (6) into which open at least one inlet (8) and at least out outlet (10), and a rotary piston (20) rotating inside the cylinder chamber (4) which, together with at least one region of its outer peripheral surface (22) forms a seal with the inner peripheral surface (6) of the cylinder chamber (4) and is separated in regions from the inner peripheral surface (6) by a radial stroke distance. When the rotary piston rotates (arrow 70), an expanding working chamber (24) is formed in the region of the inlet (8) to draw the medium in and, on further rotation, contracts again in the region of the outlet to force the medium out. The working chamber (24) concerned is limited, at least during its increase or decrease in volume, by at least one separating slide (26) in front of the inlet (8) or behind the outlet (10) viewed in the direction of rotation. Said slide is moved to and fro (arrow 32) in the pump casing (2), as the rotary piston (20) rotates, in a substantially radial direction to the axis of rotation (34) in such a way that it forms a seal with the outer peripheral surface (22) of the rotary piston (20). The separating slide (26) is forcibly moved by means of a drive device (30) synchronised with the rotary piston (20).

12 Claims, 7 Drawing Sheets

ROTARY PISTON PUMP HAVING SYNCHROUSLY DRIVEN DIVIDING SLIDES AND DOSING DEVICE

The present invention pertains to a rotary piston pump for conveying flowable or pourable, particularly liquid, pasty or granular media, consisting of a pump housing with a cylinder chamber with a cylindrical inner circumferential surface, into which at least one inlet and at least one outlet open, as well as a rotary piston which is located inside the cylinder chamber, where the rotary piston has an outer circumferential surface whose radial distance from the axis of rotation changes over the circumference in such a manner that the rotary piston works in cooperation with at least one area of the outer circumferential surface to form a seal with the inner circumferential surface of the cylinder chamber and is separated in some areas from the inner circumferential surface by a radial stroke distance with respect to the axis of rotation, so that during the rotation of the rotary piston in each case a working chamber whose volume increases is formed in the area of the inlet for the suction of the medium to be conveyed, which chamber subsequently after the continuation of the rotation again decreases in volume in the area of the outlet for the displacement of the medium, where the working chamber concerned is limited at least during the time of the increase or decrease in volume by at least one separation slide which is located, seen in the direction of rotation, before the inlet or after the outlet, and which is moved back and forth in the pump housing during the rotation of the rotary piston essentially in a radial direction with respect to the axis of rotation so that it works in cooperation with its surface which is turned toward the rotary piston and at all times forms a seal with the outer circumferential surface of the rotary piston.

Figure 6:
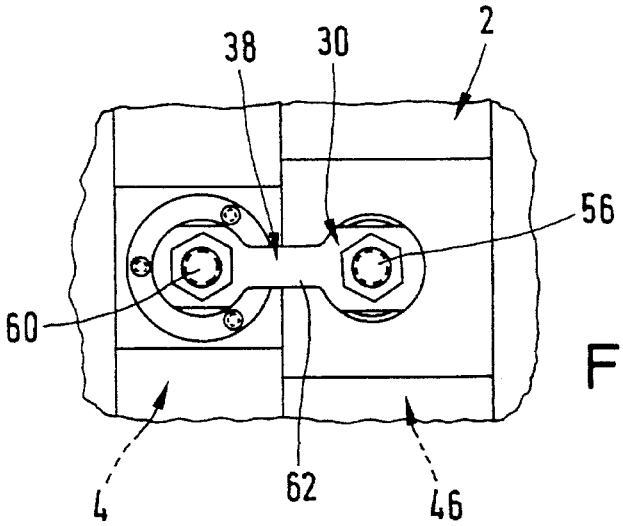
Figure 7:
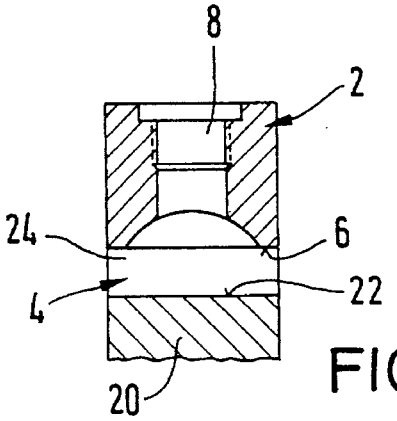

Such rotary piston pumps are known; reference is made for example to "Lueger, Lexikon der Technik," DVA-Stuttgart, Vol. 7, 1965, p. 218, FIG. 7 and Vol. 16, 1970, pp. 243, 244 and FIG. 6. Each one of these known pumps has an inlet and a directly adjacent outlet, located in the direction opposite the rotational direction and separated in the rotational direction by a circumferential "conveyance path." The rotary piston has a cylindrical outer circumference and it is connected eccentrically with a shaft which is coaxial to the cylinder chamber in such a manner that at a place of its outer circumference it comes tangentially in contact with the inner circumferential surface of the cylinder chamber in the form of a line, which results during its rotation in the formation of work chambers whose volume can change. Between the inlet and the outlet a separating slide is provided for a separation between the suction side and the pressure side, which separating slide always separates the work chamber which is increasing in the area of the inlet from the work chamber which is decreasing in the area of the outlet during the rotation of the rotary piston. This means that the separating slide always delimits the work chamber before the inlet and behind the outlet. The separating slide in this process is pressed by a spring against the outer circumference of the rotary piston and it is therefore moved back and forth immediately during the rotation of the piston. This is disadvantageous because a high degree of friction occurs between the separating slide and the rotary piston associated with correspondingly high wear. This drawback can only be reduced by lubrication; however, lubrication is only unproblematic if it can occur by means of the medium to be conveyed itself, that is, for example, if the medium itself is oil. However, if another medium has to be conveyed, such a lubrication can be considered only conditionally, in order not to "contaminate," that is chemically change, the medium with the lubricant. Consequently, the known pumps are therefore either not suited or suited only conditionally for the transport of foods, for example dairy products. The described compression to the separating slide by means of a spring additionally is also a drawback to the extent that under certain conditions resonance phenomena may occur which can result in a "fluttering" of the separating slide and thus cause undesired leaks between the suction and pressure side. A regulation of the spring must therefore occur at all times so that the vibration of the "spring/separating slide system" itself is high compared to the rotational frequency. As a rule, this can be achieved satisfactorily only if a strong spring (high spring force) is used; however, this in turn disadvantageously increases the friction between the separating slide and the rotary piston.

In German Utility Model U 6,931,657 a rotary pump is described which has a rotary piston with polygonal cross section which is located on a bearing in a cylindrical borehole of a case in such a manner that it can be rotated. In each case a separating element is arranged like a slide between an outlet line and a suction line which follows in the rotational direction, to separate these lines from each other, where each one of these separating elements parts is guided in the piston case in such a manner that it can be slid and it is applied against the circumference of the piston by means of spring pressure. A spring element is provided for this purpose, which is in the form of an annular spring and which applies spring forces, which are directed radially to the middle, onto the separation member. This shows that this known rotary pump essentially corresponds to the state of the art already described above, because the slide-like separation members are driven by their apposition to the rotary piston immediately by the latter. Here too the same drawbacks essentially develop.

In French Patent No. A 2,646,389 a hydraulic machine is described, which can be used either as pump or as motor. Here too separating slides are moved immediately as a result of the apposition to the cam surfaces of the case.

The present invention is based on the task to create, starting from the state of the art, a rotary piston pump of the mentioned type, which operates reliably under all operational conditions with low wear and low development of noise, and with a low drive performance requirement, and which is suited for the transport of nearly any media, particularly media which are mechanically and chemically sensitive, such as dairy products.

According to the invention this is achieved by the fact that the displacement of the separating slide occurs necessarily by means of a drive installation which is synchronized with the rotary piston. It is in this context advantageously possible to move the separating slides in such a manner that it is always, that is in each rotational position of the piston, separated over a small defined sealing gap from the outer circumferential surface of the rotary piston so that in this area any friction with all the disadvantageous consequences it would have can be avoided entirely, advantageous. Consequently, in this area lubrication can be omitted, so that contamination of any conveyed transported medium with lubricant is entirely prevented. The pump according to the invention is therefore suited above all for foods, particularly dairy products, in particular in view of the fact that the principle of the design transports the medium almost without pressure ("entrainment" via the work chambers), so that mechanically sensitive media, such as emulsions, are transported under very mild conditions; advantageously a mechanical "breaking" of the emulsion (for example milk, cream and similar products) as occurs for example with semirotary or centrifugal pumps which do not fall in this category is avoided.

It is particularly advantageous if the drive installation is in the form of a cam drive which has, in a preferred embodiment, at least one cam track (curved control track) which is designed in the form of a groove which is open in the direction of the axis of rotation and which rotates synchronously and coaxially with the rotary piston, in which in each case a cam is guided which is connected with the separating slide via a motion transfer element. In this case the cam track, as far as its circumferential course is concerned, is adapted precisely to the course of the outer circumferential surface of the rotary piston, so that the separating slide, during the rotation of the rotary piston, follows with its surface which is turned toward the piston exactly the course of the piston outer circumference as a result of a radial back-and-forth motion. Advantageously, the resonance phenomena described above are also avoided in this case by the "restricted guidance" according to the invention so that under all operating conditions (for example at any desired rpm value) an optimal sealing effect in the area of the separating slide concerned is maintained at all times.

In a particularly advantageous embodiment of the invention several, specifically three, component pumps are provided inside the pump housing, distributed at equal intervals over the circumference of the cylinder chamber, each one component pump having one inlet and one outlet. In this arrangement in each case one inlet of one of the component pumps is located adjacently, at a small distance, with respect to the outlet of the adjacent component pump, in a direction opposite to the rotational direction (arranged in front in the rotational direction), and a separating slide is provided in each case between the outlet of one component pump and the inlet of the other component pump. All the separating slides present are then driven by the same drive installation, by guiding the corresponding cam for each separating slide in the same cam track in each case.

Further advantageous characteristics of the form of the invention are described the following description.

Figure 1:
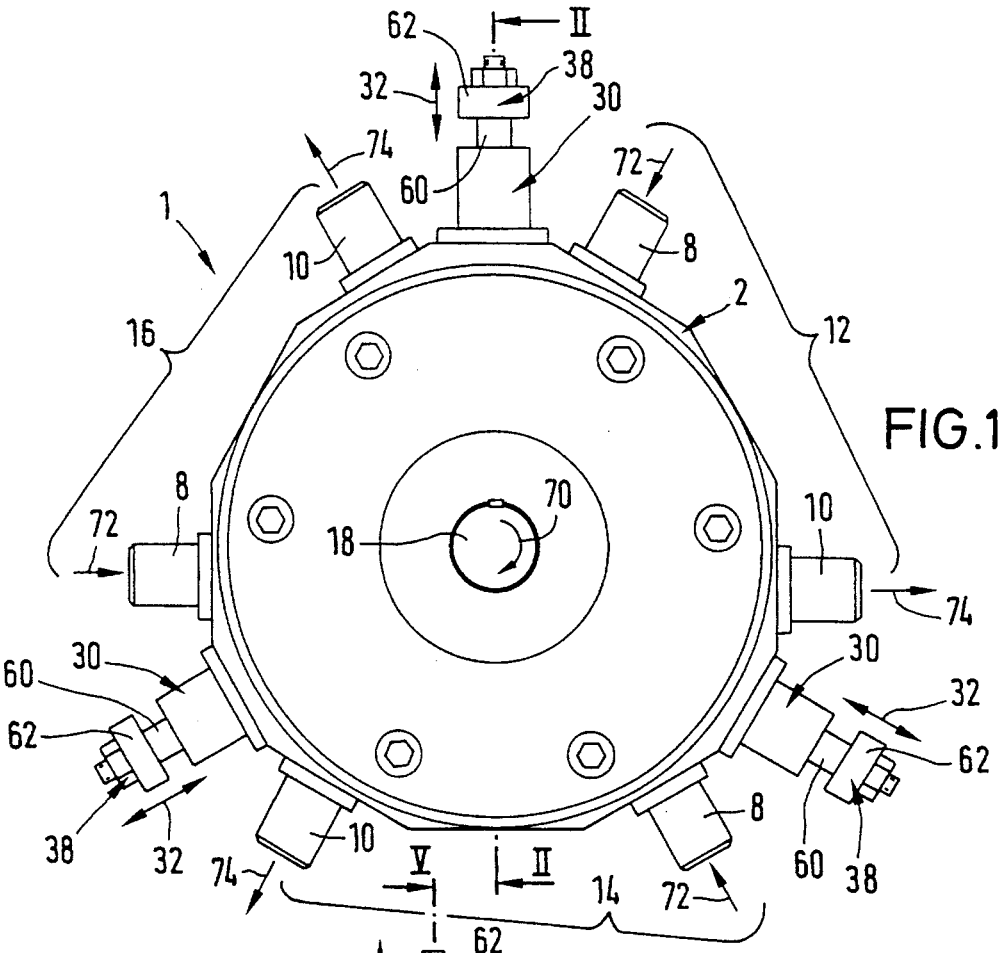
Figure 2:
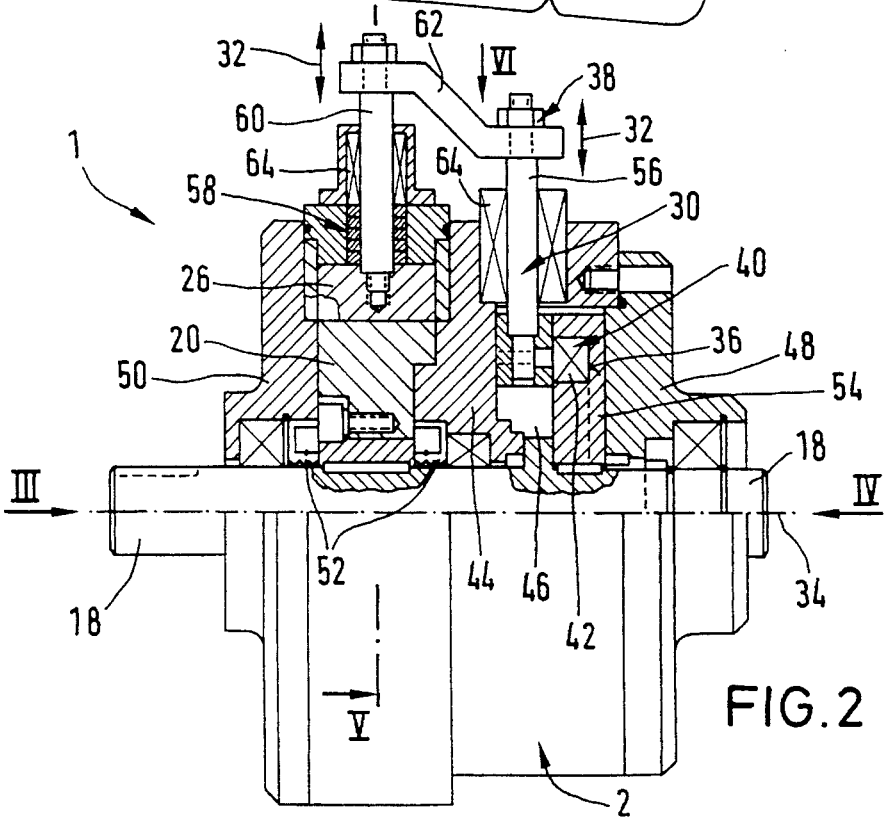
Figure 3:
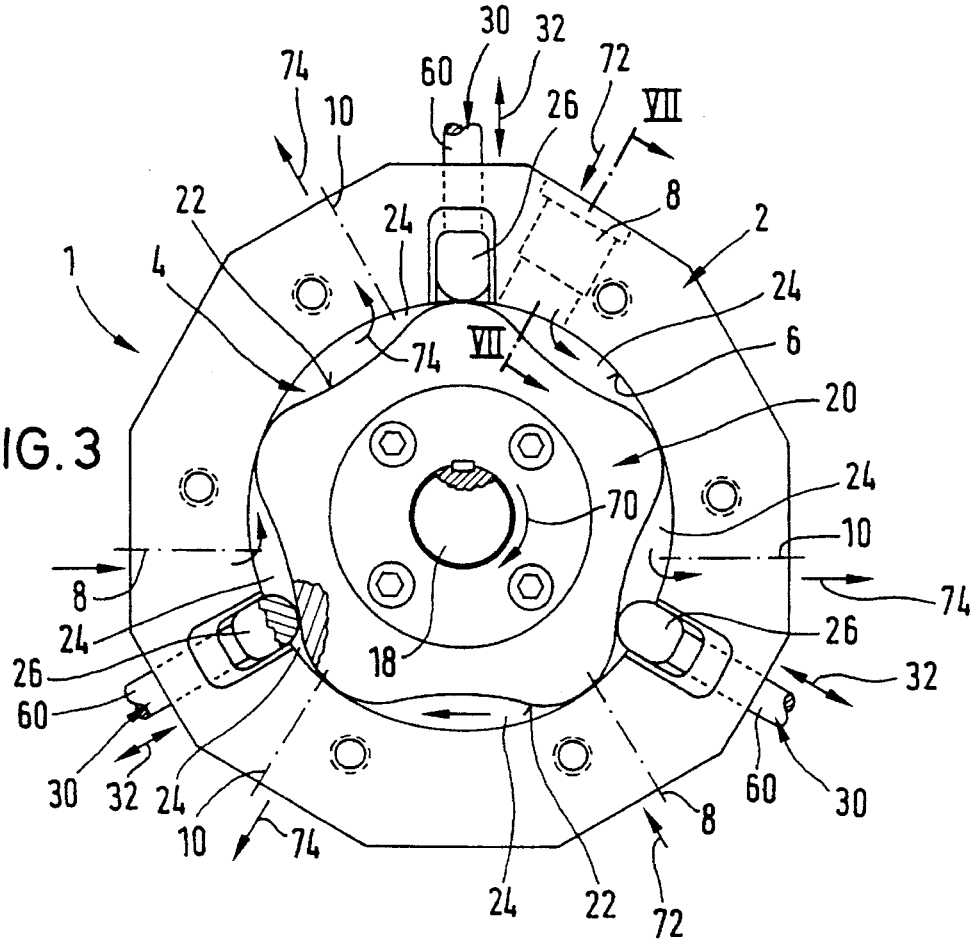
Figure 4:
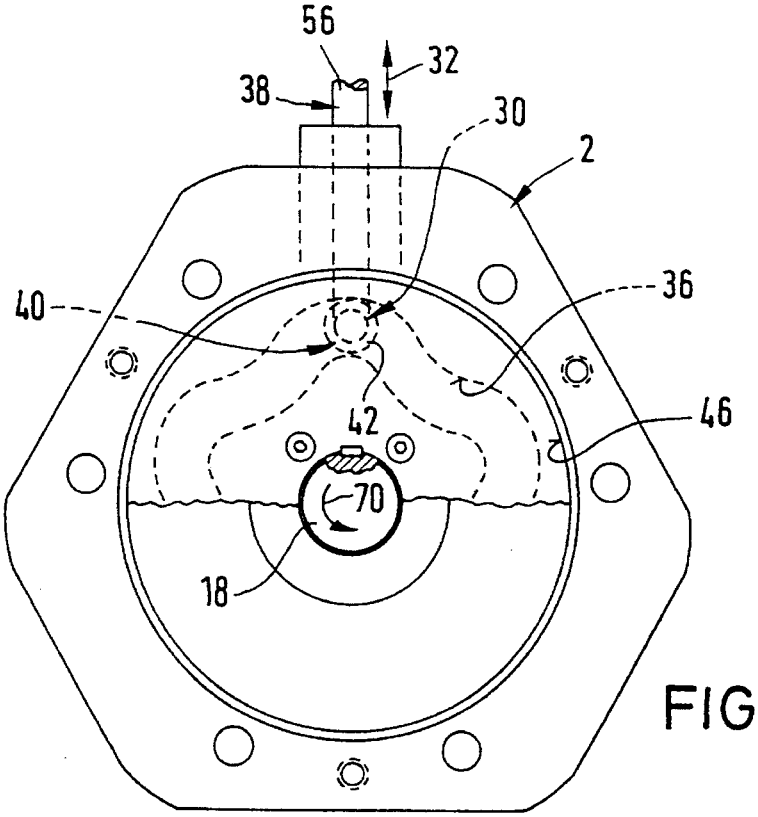
Figure 5:
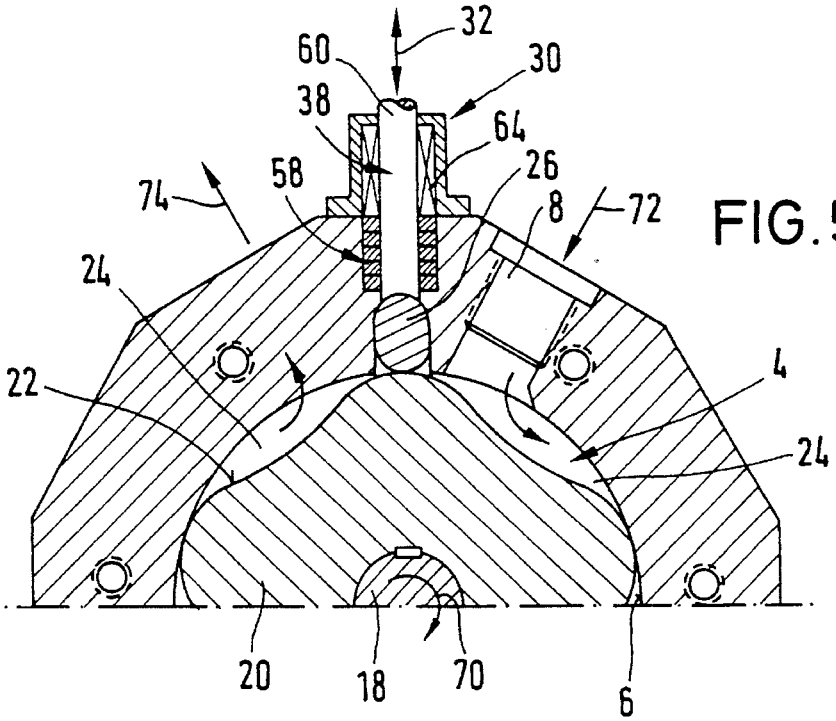
Figure 8:
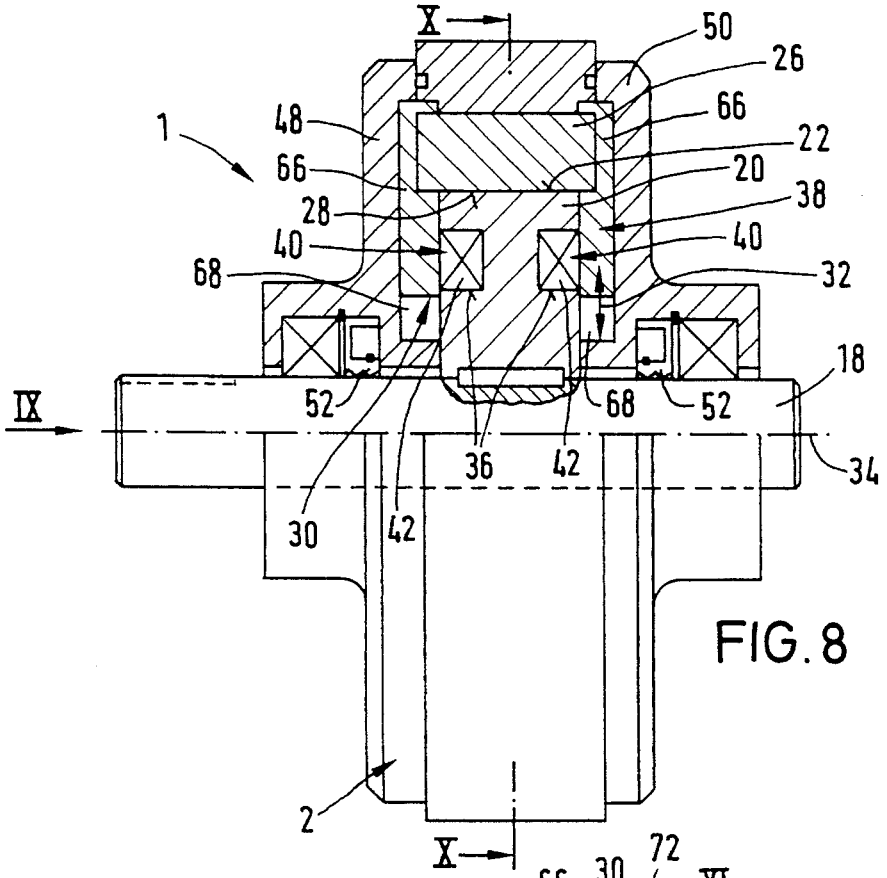
Figure 9:
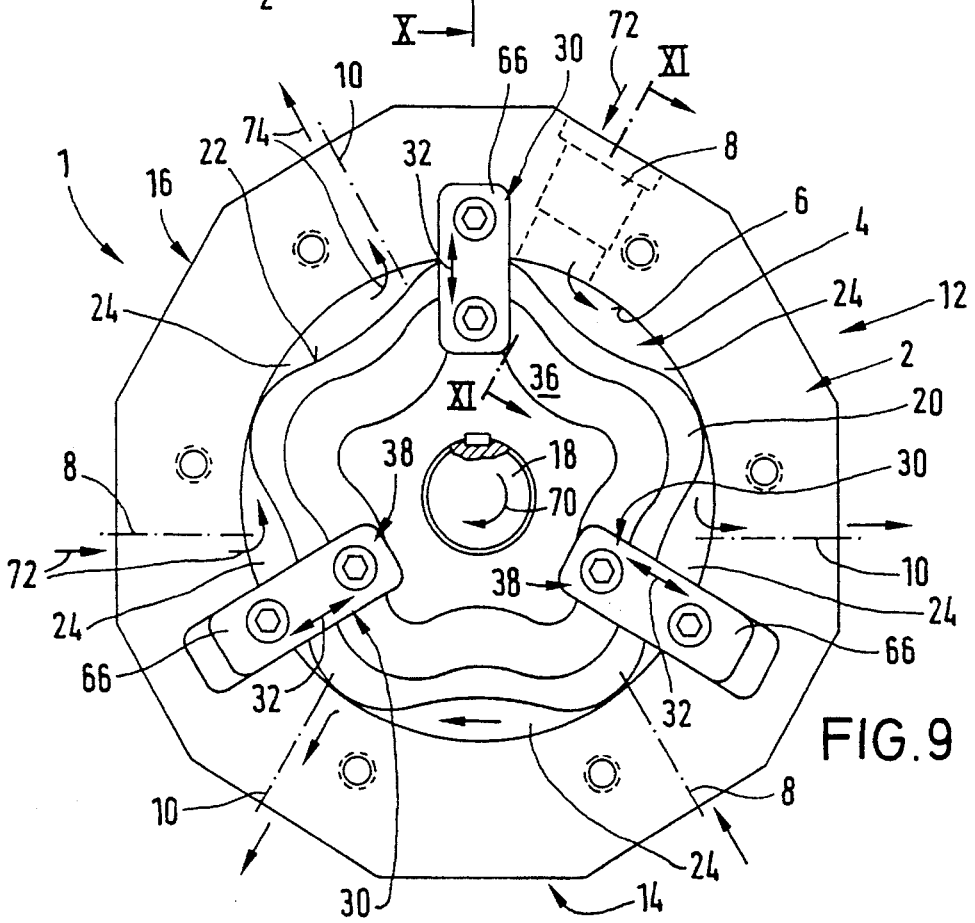
Figure 10:
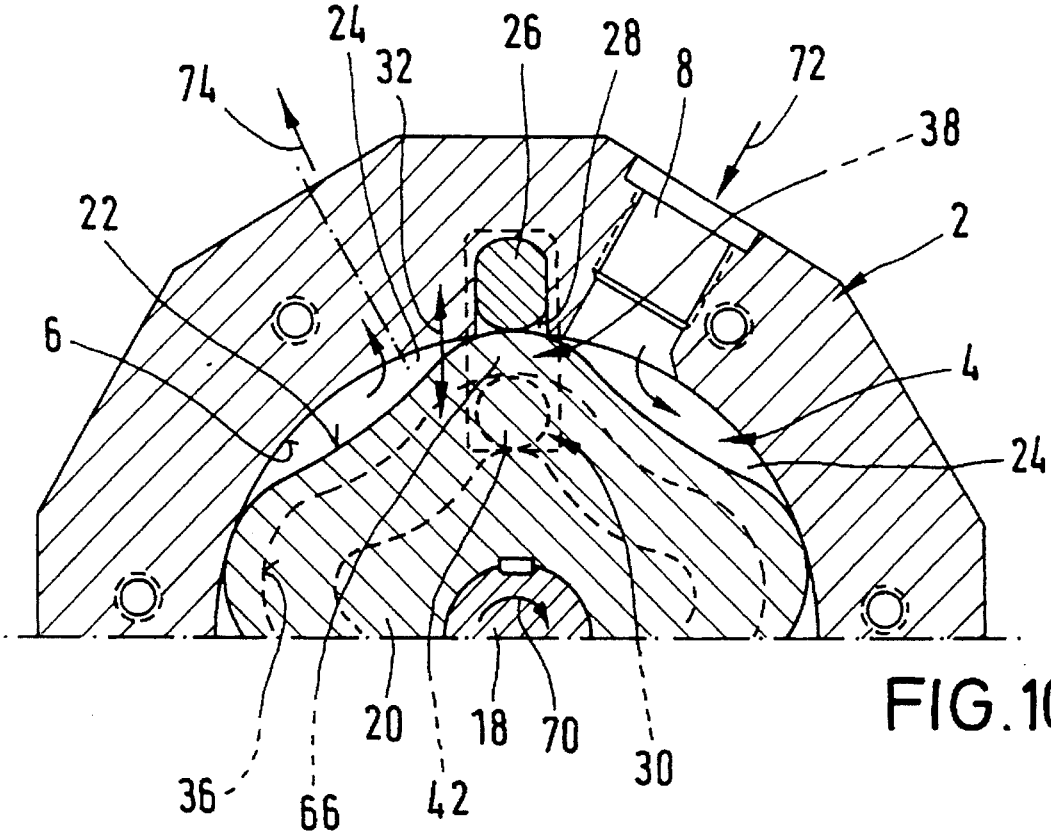
Figure 11:
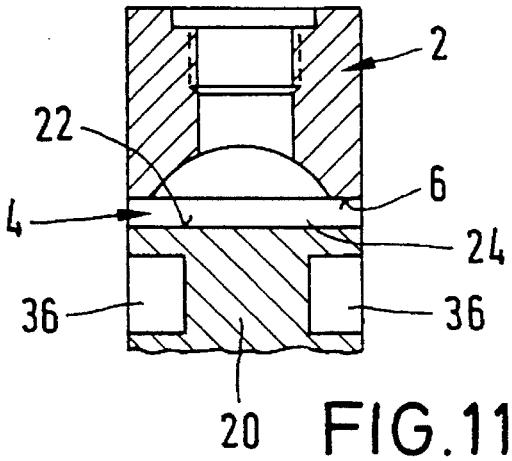
Figure 12:
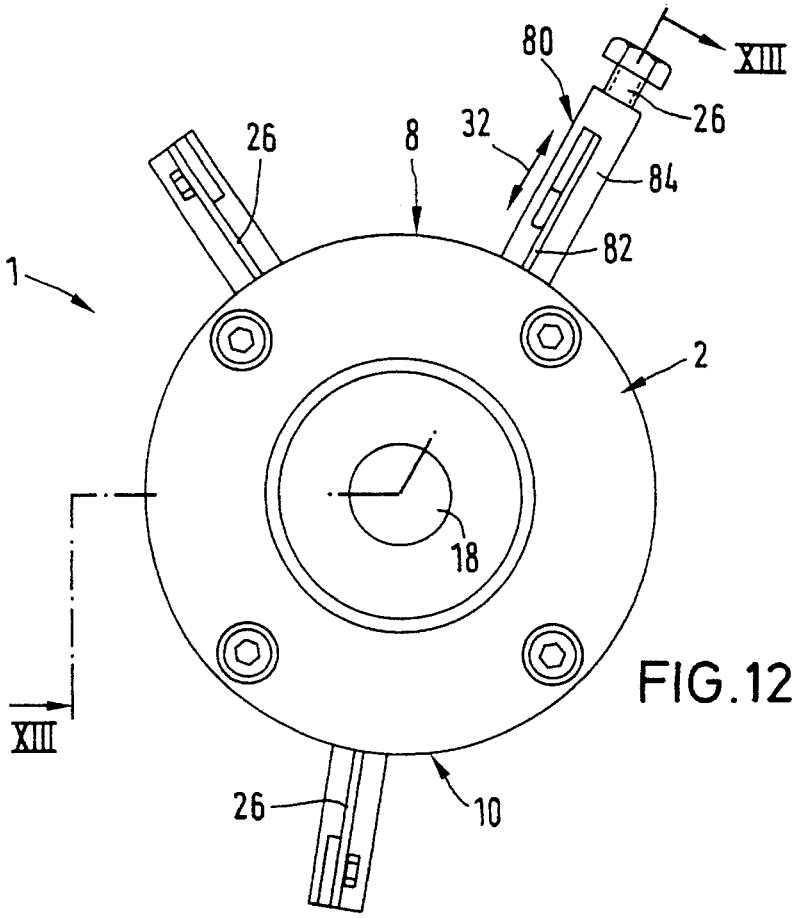
Figure 13:
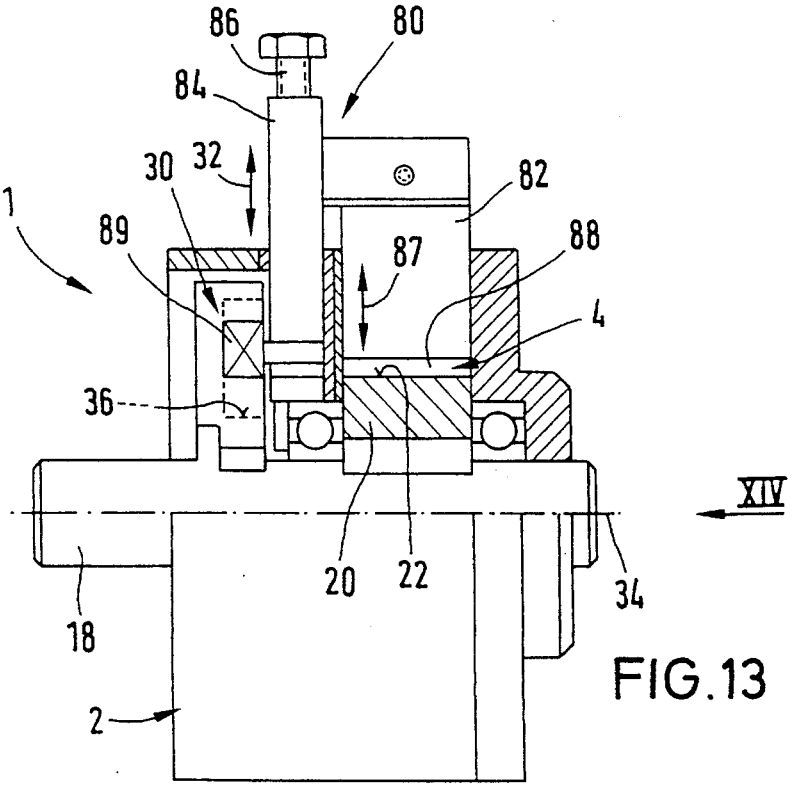

Using preferred embodiment examples represented in the drawing the invention is explained in greater detail below. In the drawings:

FIG. 1 represents an axial frontal view of a rotary piston pump according to the invention in a first embodiment, FIG. 2 represents a semiaxial cross section along line II—II of FIG. 1, FIG. 3 represents an axial frontal view in the direction of arrow III of FIG. 2, with omission of a cover of the case, FIG. 4 represents an axial rear view in the direction of the arrow IV of FIG. 2 with partial omission of a cover of the case, FIG. 5 represents a partial cross section along line V—V in FIG. 2, FIG. 6 represents a top view of a detail in the direction of arrow VI of FIG. 2, FIG. 7 represents a partial cross section along line VII—VII of FIG. 3, FIG. 8 represents a partial axial cross section of a second embodiment of a rotary piston pump according to the invention, FIG. 9 represents a frontal view in the direction of arrow IX of FIG. 8 with omission of a cover of the case, FIG. 10 represents a partial cross-sectional view along line X—X of FIG. 8, FIG. 11 represents a partial cross section along line XI—XI of FIG. 9, FIG. 12 represents an axial front view similar to FIG. 1 in an additional embodiment of the rotary piston pump according to the invention, FIG. 13 is a partial axial cross section along line XIII—XIII of FIG. 12.

Figure 14:
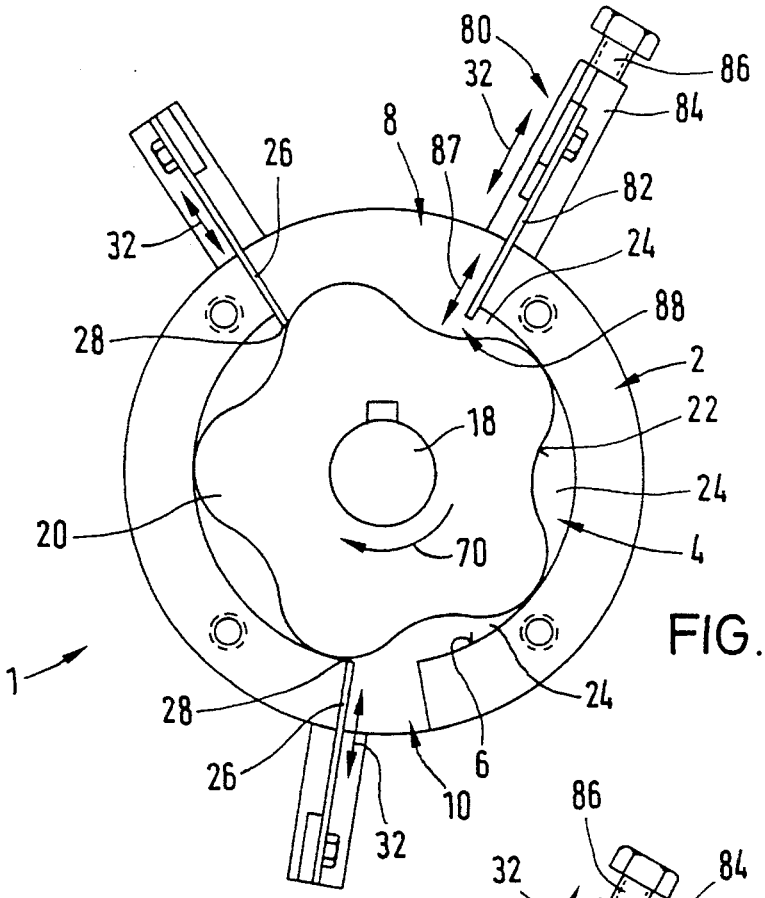
Figure 15:
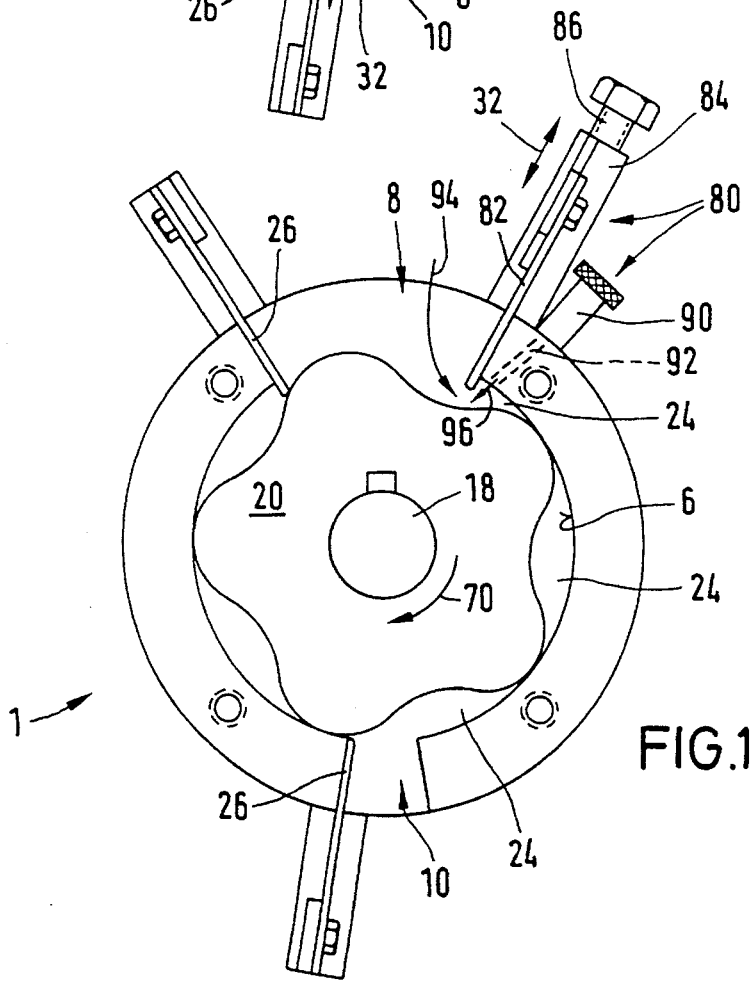

FIG. 14 is an axial frontal view as in FIG. 12, that is, in the direction of arrow XIV of FIG. 13, however with omission of one of the front covers of the case, and FIG. 15 is a view analogous to FIG. 14, however in an additional embodiment of the invention.

In the various figures of the drawing, the same or corresponding parts and components are always marked with the same reference numerals, so that each description provided for a part in a particular figure is valid for the other figures in which this part is likewise found.

A rotary piston pump 1 according to the invention comprises a pump housing 2 with a cylinder chamber 4 that presents a cylindrical inner circumferential surface 6 (see in particular, FIGS. 3 and 5, FIGS. 9 and 10, as well as FIGS. 14 and 15). The pump housing 2 comprises at least one inlet 8 and at least one outlet 10, which each lead to the area of the inner circumferential surface 6 in the cylinder chamber 4. In the preferred embodiments illustrated in FIGS. 1–7 and in FIGS. 8–11, however, within the pump housing 2, several, in particular three, component pumps 12, 14, and 16 are formed, evenly distributed over the circumference of the cylinder chamber 4 for both inlet 8 and outlet 10 (concerning this, see in particular FIG. 1; in the remaining figures the inlets and outlets are generally shown only with dotted lines). The component pumps 12, 14, 16 are each arranged about 120° apart. At the inlet 8 and outlet 10, connection lines may be connected; these are not illustrated. Within the cylinder chamber 4, a rotary piston 20 is mounted so that it may be rotationally driven via a drive shaft 18 that is coaxial to the cylinder chamber 4 or the inner circumferential surface 6. This rotary piston 20 comprises a similarly formed outer circumferential surface 22, so that during its rotation it works together with the inner circumferential surface 6 in a sealed fashion by area, and all the working chambers 24 are formed between the outer circumferential surface 22 and the inner circumferential surface 6 of the cylinder chamber 4 on the basis of a radial "stroke distance;" the volumes of these working chambers increase to draw a supporting medium that is flowing out through the respective inlet 8 and decrease when rotation resumes to drive the medium out again in the direction of the respective outlet 10.

For separating the individual component pumps 12, 14, 16, a separating slide 26 is arranged in each case between the outlet 10 of a component pump 12, 14, and 16 and the adjacent inlet 8 of the next component pump 14, 16, and 12 in the rotational direction; this separating slide has an axial length that basically corresponds to the axial length ("internal headroom") of the cylinder chamber 4—up to a narrow play. Separating slides 26 are each movably mounted in the pump housing 2 in approximately the radial direction and work together to separate each of the "suction" working chambers 24 from a "driving out" working chamber 24, sealing with the outer circumferential surface 22 of the rotary piston 20. This means that each separating slide 26 similarly moves back and forth during the rotation of the rotary piston 20, that its upper surface 28, facing the rotary piston tangent to the outer circumferential surface 22 of the rotary piston 20, preferably stands off over a slight narrow sealing gap (not recognizable in the drawings) from the outer circumferential surface 22.

This is achieved in the invention by the fact that each separating slide 26 of a drive unit 30 synchronized with the rotary piston 20 is similarly driven back and forth in both radial directions, that the separating slide compulsorily follows the "radial stroke distance/path," which during rotation of the rotary piston 20 follows the previously moving outer circumferential surface 22 at the separating slide 26, with the upper surface 28 facing the rotary piston 20. The motion of the separating slide 26 is illustrated in the figures by double arrows 32.

As is illustrated next, on the one hand, in FIGS. 1–7, and on the other hand, in FIGS. 8–11, the drive device 30 is preferred to be formed as a cam drive and thus provides at least one cam track (control curve) 36, which rotates synchronously and coaxially with the rotary piston 20 in the direction of the axis of rotation 34, for example, an open groove, in which, for each separating slide 26, a cam 40 is carried, which is connected to it via a motion transfer element 38. In order to generate the least possible friction in the area of each cam 40 carried in the cam track 36, each cam 40 is advantageously formed as an unwinding cam roller (curve roller) 42 connected with the motion transfer element 38, so as to be rotatable in the cam track 36. The cam roller 42 can advantageously be formed from a rolling-contact bearing.

Both embodiment examples according to FIGS. 1–7, on the one hand, and FIGS. 8–11, on the other hand, differentiate themselves primarily through the constructive design of the motion transfer element 38. These differences will be clarified in the following.

According to FIGS. 1–7, the drive device 30 is arranged in a separate housing chamber 46, separated from the cylinder chamber 4 by a separating wall 44. This housing chamber 46 practically forms a "gearing housing." The drive shaft 18 of the rotary piston 20 extends through an opening in the separating wall 44 and through the housing chamber 46 and is mounted in a housing cover 48 closing the housing chamber 46 on its side that does not face the separating wall 44. On the side of the cylinder chamber 4 lying opposite the separating wall 44, this is closed by an additional housing cover 50. The drive shaft 18 extends through an opening of the housing cover 50 and a storage area connected here to the outside, and it may be connected there with a drive element, which is not illustrated. On both sides of the cylinder chamber 4, this is sealed against the drive shaft 18 in each case by a shaft sealing ring 52. In the separate housing chamber 46, a cam plate 54 is now arranged and connected with the drive shaft 18, so as to prevent torque, so that it rotates synchronously with the rotary piston 20. The cam plate 54 provides a cam track 36 on its side facing the separating wall 44. Each of the cams 40 engaging with the cam track 36 is—as already explained—connected with the associated separating slide 26 via the motion transfer element 38. Thus, the motion transfer element 38 in this embodiment form (see in particular FIG. 2) is composed of a guide tappet 56 connected to the cam 40 and leading out of the pump housing 2 or the housing chamber 46 to the outside, a control tappet 60 connected to the separating slide 26 and leading out of the pump housing 2 or the cylinder chamber 4 to the outside, sealed with a seal 58, as well as connection part 62 connecting the guide tappet 56 outside the pump housing 2 to the control tappet 60. This connection part 62 is—as best seen in FIGS. 2 and 6—formed as a bridgelike carrier axle and is rigidly connected to the tappets 56 and 60, in particular, screwed together. The seal 58 sealing the control tappet 60 is preferably formed as a pack of many individual ring seals. The guide tappet 56 and the control tappet 60 are generally held in a bearing 64 in the direction perpendicular to the axis of rotation 34, i.e., the radial direction, without play. Each bearing 64 is preferably formed as a surrounding ball-type nipple. In addition, there are naturally tappets 56 and 60 similarly arranged in the axial direction aligned with the circumferential area of the pump. This embodiment form is suitable for practically any medium on account of the "media sealing" separating of the cylinder chamber 4 and "gearing housing" (housing chamber 46). Here, a friction reducing lubricant can even be employed advantageously in the area of the drive device 30 without the possibility that the extracted medium might be contaminated.

On the other hand, in the embodiment form according to FIGS. 8–11, the drive device 30 is arranged in the cylinder chamber 4 together with the rotary piston 20. As may be inferred in particular from FIG. 8, in this embodiment, the cylinder chamber 4 is directly locked on both sides by the housing covers 48 and 50; the seal to the outside is made, on the other hand, by the shaft sealing ring 52. Here, the rotary piston 20 preferably has a cam track 36 in both of its front surfaces, where two cams 40 are provided for each separating slide 26; these cams are each guided in one of the two cam tracks 36. The motion transfer element 38 in this case suitably comprises two guide slides 66, which are arranged on the opposite front sides of the rotary piston 20 and each connect one of the cams 40 to a front side of the separating slide 26. This can also best be seen in FIG. 8. The guide slides 66 are always led in the radial direction in guide recesses of the pump housing, in particular, in guide depressions 68 of the housing covers 48 and 50, basically without play. This embodiment form of the rotary piston pump 1 of the invention is suitable in particular for extraction of "granular" and thick fluid (high viscosity) media. With such media, it can be ensured in this way that no medium reaches the area of the drive device 30, even though it is arranged within the cylinder chamber 4.

In the following, additional advantageous forms are clarified, which are equally valid for both of the embodiment forms of FIGS. 1–7 and FIGS. 8–11.

According to the invention, the inlets and outlets 8 and 10 as well as the rotary piston 20 are arranged relating to the areas of its outer circumferential surface 22 working together to seal with the inner circumferential surface 6 of the cylinder chamber 4 which are formed in such a way that in all positions of the rotary piston 20 within each component valve 12, 14, and 16, the inlet 8 is separated from the corresponding outlet 10. This means, that in no piston position is there a direct "connecting passage" from inlet 8 to outlet 10. This is achieved in the preferred embodiment form with the three component valves 12, 14, and 16 set apart from one another by 120° by the fact that the rotary piston 20 provides a cross section which approximately corresponds to a regular polygon, and in fact at least a pentagon. Advantageously, in this case, the rotary piston 20 is formed rounded off as convex curves in the area of the vertices of its cross section as seen from the peripheral direction. In these areas, the rotary piston 20 works together in a sealed fashion with the inner circumferential surface 6 of the cylinder chamber 4. The sealing operation can, depending on the extracted medium, be achieved through an axially aligned linear structure or, on the other hand, through a narrow defined sealing gap. In addition, the rotary piston 20 can advantageously provide radial sealing elements, which are also not illustrated, of a known type that extend in the axial direction; these elements lie on the inner circumferential surface 6 in order to form a seal. Furthermore, the rotary piston 20 is preferably formed in the areas of the side surfaces of its pentagonal cross section as a concave curve, as seen from the peripheral direction. This leads to a formation or expansion of the working chamber 24 and in addition, to an expansion of the extracted volume of the pump. Here, the convex and concave cambers of the rotary piston 20 naturally and suitably change smoothly from one to the other. For this, particularly refer to FIGS. 3 and 5 or FIGS. 9 and 10. In this connection, it is further advantageous if the upper surface 28 of each separating slide 26 also forms with the rotary piston 20 a convex camber, again as seen in the direction of rotation. The curvature of this camber is such that the sealing operation at the circumferential contour of rotary piston 20 is achieved in the central radial plane of each separating slide 26.

As already mentioned, on the basis of this specific form it is ensured that at no position of the rotary piston 20 is an inlet 8 connected to the corresponding outlet 10. Rather, the inlet is always separated from the outlet by at least one "sealing area" of the rotary piston 20. In each position of the rotary piston 20, there are two "sealing areas" with a working chamber 24 closed off from it between the inlet 8 and the outlet 10 (for this, see each of the "lower" working chambers 24 in FIGS. 3 and 9).

For the sake of completeness it should be mentioned that the pump housing 2 preferably consists of stainless steel (e.g., V2A), nickel bronze, or plastic. The rotary piston 20 consists of nickel bronze or plastic. Depending on the application, however, a ceramic material can also be utilized for the housing and/or the piston.

The function of the rotary piston pump 1 according to the invention ought to have become sufficiently clear from the description above, together with the drawings. Upon rotation of the rotary piston 20 in the direction of the arrows 70, the respective medium is drawn in through the inlets 8 in the direction of arrows 72 and subsequently discharged in the direction of arrows 74 through outlets 10. At this point it only remains to be pointed out that the rotary pump 1 according to the invention is, in principle, suitable for both rotational directions (counterclockwise/clockwise); in the case of a rotational direction in the reverse direction of arrow 70, the functions of the inlets and outlets 8 and 10 would simply be "reversed," that is, each inlet 8 would become an outlet and each outlet 10 would become an inlet, so that the arrows 72 and 74 would be correspondingly reversed.

The pump according to the invention operates with a very small amount of friction and wear, so that only a small amount of drive power is required. The rotary piston 20 is preferably driven at a speed of 16–230 RPM. For each revolution a volume of approximately 0.25 L is transported. The concrete embodiment with three component valves and a "pentagonal" rotary piston 20 is also particularly advantageous in this case because in this way—connecting all inlets 8 together on the one hand, and all outlets 10 on the other hand—a very uniform pump output is obtained because the pump cycles of the individual component pumps are temporally distinguished or overlap. Additionally, this special embodiment also leads to a "shortening" of the transport paths (in the circumferential direction) within the pump 1 according to the invention, that is to say, the medium is transported by the piston 20 over only a part of the circumference, in this special case less than 120° (angular gap between the inlet 8 and outlet 10). By comparison to the prior art, where there was travel over almost 360°, the pump according to the invention thus "treats" the medium much more "gently."

On the basis of FIGS. 12–15, certain advantageous improvements of the invention will now be discussed. The rotary piston pump 1 illustrated in FIGS. 12–14 is specially configured as a "metering pump" for granular powdery media, that is, substances consisting of individual, more or less large particles and therefore not capable of "flowing" like liquids, but only capable of being "poured." Thus, we are dealing with "bulk material." As can be discerned in FIG. 14 in particular, the rotary piston pump 1 in this embodiment has only one inlet 8 and only one outlet 10. The rotary piston pump 1 is therefore set up in operation, with respect to its position in space, such that its axis of rotation 34 runs essentially horizontal. Inlet 8 and outlet 10 are diametrically opposite one another and at least approximately on the vertical line, with the inlet 8 as the housing opening pointing upward, while the outlet 10 is opened vertically downward. In the vicinity of the inlet 8, it is practical to arrange a feed hopper, not shown here however, for holding and feeding the respective material, with the material then sliding (flowing) downward into inlet 8 primarily under the influence of gravity. A first separating slide 26 is arranged upstream of the inlet 8, viewed in the rotational direction of the rotary piston 20 (see arrow 70 in FIG. 14), and a second separating slide valve 26 is arranged downstream of the outlet 10, so that the medium reaching the cylinder chamber 4 via inlet 8 is then transported (carried along) by the working chamber 24 to outlet 10, where it once again falls down out of the pump 1 essentially under the influence of gravity. The two separating slides 26 correspond to the explanations above, particularly as concerns their "automatic driving" by drive device 30, so that at this point one can simply refer to that section. Here of course the separating slides 26 do not separate "component pumps," because only one pump (one inlet and one outlet) is present.

According to the invention, a metering device 80 is now provided which serves to vary the "cycle transport volume" per transport cycle in each of the working chambers 24, with it being preferably possible to adjust the respective cycle transport volume continuously from zero to the maximum volume of the respective working chamber 24.

In the embodiment example according to FIGS. 12–14—see, in particular, FIG. 14 on this point—the metering device 80 is arranged between the inlet 8 and the outlet 10, for which purpose the inlet 8 is delimited in the direction of rotation (arrow 70) of piston 20, that is, on the side opposite separating slide 26 in the rotational direction, by a metering slide 82 constituting the metering device 80. This metering slide 82 is mounted on a holder 84 in such a way that it can be displaced relative to the holder 84, preferably by a threaded spindle 86, in the radial direction with respect to rotary piston 20 (see double arrow 87), so that an inlet gap 88 with variable free width, measured in the radial direction, results between the outer circumference 22 of rotary piston 20 and the end of metering slide 82 pointing toward it. Here the holder 84 supporting the metering slide 82, analogously to the separating slides 26, is driven back and forth radially by the drive device 30 (see FIG. 13), as is indicated by the corresponding double arrow 32. To this end, the holder 84 of metering slide 82 is connected to a cam 89, which is guided in the previously mentioned cam track 36, so that the driving of the metering slide 82 is also done synchronously with the revolution of the rotary piston 20. This is necessary because, when set for a reduced transport volume, the metering slide 82 projects radially part way into the cylinder chamber 4, as can clearly be recognized in FIG. 14, where, however, it is assured that by the driving of holder 84 that the metering slide 82 escapes radially outward in each case when the areas of rotary piston 20 that would make contact with it pass the area of metering slide 82.

It is also easily recognizable in FIG. 14 that the working chamber 24, formed starting from inlet 8 during rotation of rotary piston 20 and increasing in volume, can be filled only through the inlet gap 88 formed by the metering slide 82, so that the "amount of filling," that is the respective cycle volume transported in one of the working chambers 24, is variable in this way.

This described design of the rotary piston pump 1 according to FIGS. 12–14 with a metering slide 82 is suited particularly to granular and powdery media, such as instant drink or soup powder, but also, to a certain extent at least, to materials ranging from viscous to pasty in consistency. For less viscous media this embodiment can be used if desired in those cases when the metering slide 82 has a "relatively long" contact surface as viewed in the direction of rotation of piston 20, since in that way the inlet gap 88, acting as a "throttle gap," would cause an increase in flow resistance for the medium. In this connection, however, it is particularly advantageous to let a certain volume of air into the enlarged working chamber 24 downstream of inlet 8 and metering slide 82, where the volumetric ratio of medium:air is variable according to the invention.

As can be seen from FIG. 15, an adjustable ventilation valve 90 is provided for this purpose; it should be pointed that this ventilation valve 90 can, in principle, be employed equally well without the metering slide 82 , so that the ventilation valve 90 then constitutes the metering device 80. In the preferred embodiment illustrated in FIG. 15, however, the metering slide 82 and the ventilation valve 90 are combined.

Immediately downstream of inlet 8 in the rotational direction of piston 20—and in the example with metering slide 82—downstream of the metering slide 82, a housing channel 92 (drawn in dashed lines in FIG. 15) issues into the area of the expanding working chamber 24 and is connected to external air via ventilation valve 90. The ventilation valve 90 is configured in such a way that the amount of air drawn in through it via channel 92 can preferably be varied from zero to a given maximum value.

As already indicated, the transport volume of the medium is metered by ventilation valve 90 in that there is always a portion of medium flowing in the direction of arrow 94 and a portion of air flowing in the direction of arrow 96, and both parts are then transported, with the mixture ratio being continuously variable by means of ventilation valve 90 and, if desired, in collaboration with the metering slide 82.

The embodiment with the metering slide 82 also offers the advantageous possibility for granular media, such as seeds, tablets or the like, of counting the pieces, that is, of transporting a very definite number of pieces to outlet 10 in each working chamber 24, so that these can then be put into packages in the respective required number. For this purpose it is preferable that the rotary piston 20 possess housing depressions 22 (not shown) for each of the pieces. The metering slide 82 is then arranged on an inlet gap 88 such that it strips off only the excess pieces, i.e. those not in the depressions, and thus does not let them into working chamber 24. For a certain uniform "filling" of all housing depression of rotary piston 20, it can be advantageous to vibrate the rotary piston pump 1 according to the invention during operation.

In an embodiment of the invention not illustrated in the figures, the metering device 80 can also be configured in such a way that the axial length of the working chambers 24, viewed in the direction of axis of rotation 34, and thus their volume as well, are variable. For this purpose, the rotary piston, the pump housing and the cutoff valves each consist of at least two parts telescopically displaceable.

In all the possible embodiments discussed, therefore, the metering device 80 according to the invention makes an exact metering of the transport volume per cycle possible. By means of the specific weight of the respective medium, however, a weight metering is also possible in a simple manner with this volume metering. The metering device 80, that is, in particular the metering slide 82 and/or the ventilation valve 90, can then be equipped with an empirically determined scale (for volume and/or weight), which makes the metering very simple. The medium falling out of outlet 10 can thus be further processed cycle by cycle as a packaging unit, for instance, filled directly into designated packaging. The setting of the metering device 80 can also be accomplished automatically by means of an automatic, and in particular, an electronic control device, by simply inputting a certain weight or volume as the desired value; the control device then automatically initiates an appropriate setting of metering device 80, in which, in particular, a comparison of desired and actual values can be performed by an automatic downstream control system.

The invention is not limited to the concretely illustrated and described embodiment examples, but includes instead all embodiments operating identically to the invention. Thus, in particular, it is possible to drive several (at least two) rotary piston pumps arranged in sequence along the same axis, where it is then advantageous that one only needs one common drive (only one cam track with motion transfer elements pointing outward) for the separating slides and/or metering slide or slides present. Furthermore the drive device operating the separating slide or slides can in principle be implemented by any arbitrary appropriate type of drive, such as a gear/eccentric drive or a servomotor drive, where in the latter case a synchronization with the rotation of the rotary piston can be accomplished by means of an electronic programmable control system.

I claim:

1. A rotary piston dosing device for conveying and dosing flowable paste-like granular media, comprising:

a pump housing (2) with a cylinder chamber (4) having a cylindrical inner peripheral surface (6) into which at least one inlet (8) and at least one outlet (10) open;

a rotary piston (20) arranged inside the cylinder chamber (4) and operative to be rotatably driven about an axis of rotation (34) coaxial to the cylinder chamber;

the piston having an outer peripheral surface (22) whose radial distance from the axis of rotation (34) changes across the periphery in such a way that at least one area of the outer peripheral surface (22) interacts in a sealing manner with the inner peripheral surface (6) of the cylinder chamber (4), and that other areas of the rotary piston are separated from the inner peripheral surface (6) by a stroke distance which is radial to the axis of rotation (34), so as to form at least one working chamber (24) respectively in the area of the inlet (8) during rotation of the rotary piston (20), for drawing the medium to be conveyed;

at least one dividing slide (26) having a surface (28) facing the rotary piston (20) to interact in a sealing manner with the outer peripheral surface (22) of the rotary piston before the inlet (8) or behind the outlet (10), as viewed in the direction of rotation of the rotary piston;

a drive device (30) synchronized with the rotary piston (20) and operative to slide the dividing slide (26) back and forth inside the pump housing (2), during rotation of the rotary piston (20), in essentially a radial direction with respect to the axis of rotation (34) so that the surface (28) of the dividing slide interacts in the sealing manner with the outer peripheral surface (22) of the rotary piston (20) to increase the volume of the respective working chamber (24) in the area of the inlet (8) and decrease the volume of the respective working chamber in the area of the outlet (10), thereby conveying the medium as the rotary piston rotates;

a dosing device (80) comprising a dosing slide (82) arranged radially and, as seen in the direction of rotation (70), directly behind the inlet (8) within the chamber (4);

a holding device (84) supporting the dosing slide (82) for selective adjustment in the radial direction relative to the holding device so as to form, between the outer periphery (22) of the rotary piston (20) and the dosing slide (82), a variable inlet gap (88) for the medium, whereby the dosing slide operates to vary the timed volume of the medium respectively conveyed in said at least one working chamber (24); and the drive device (30) is operatively associated with the holding device (84) to drive the holding device, together with the dosing slide (82), back and forth in the radial direction synchronously with the rotation of the rotary piston (20).

2. Rotary piston pump, in accordance with claim 1, characterized in that the drive device (30) is in the form of a cam drive and has at least one cam track (36), rotating synchronously and coaxially with the rotary piston (20) and made in the form of an open groove in the direction of the axis of rotation (34), in which, respectively, a cam (40) is guided which is connected with the dividing slide (26) via a motion transmission member (38).

3. Rotary piston pump in accordance with claim 2, characterized in that the drive device (30) is arranged in a separate housing chamber (46), separated from the cylinder chamber (4) via a dividing wall (44), wherein a cam plate (54) is arranged which has the cam track (36) and which is directly connected with a drive shaft (18) of the rotary piston pump (20), wherein the motion transmission member (38), connecting the cam (40) with the dividing slide (26) and gripping the cam track (36), comprises a guide plunger (56) connected with the cam (40) and guided outside the pump housing (2) toward the outside, a control plunger (60) connected with the dividing slide (26) and guided out of the pump housing (2) toward the outside in a sealed manner, and a connection part (62) connecting the guide plunger (56) with the control plunger (60).

4. Rotary piston pump in accordance with claim 1, characterized in that the drive device (30) is arranged inside the cylinder chamber (4) together with the rotary piston (20), wherein the rotary piston (20) has, in its two front surfaces, respectively, a cam track (36) and, for the dividing slide (26), two cams (40) are provided which are respectively guided in one of the two cam tracks (36) and wherein the motion transmission member (38) comprises two guide slides (66) which on the opposing front faces of the rotary pistons (20) respectively connect one of the cams (40) with one front face of the dividing slide (26).

5. Rotary piston pump in accordance with claim 1, characterized in that the inlets and outlets (8, 10) are arranged in such a way and the rotary piston (20) with respect to areas of its outer peripheral surface (22) interacting in a sealing manner with the inner peripheral surface (6) of the cylinder chamber (4) in such a way that in all positions of the rotary piston (20), the inlet (8) is separated from the accompanying outlet (10).

6. Rotary piston pump in accordance with claim 1, characterized in that the rotary piston (20) has an essentially regular polygonal cross section.

7. Rotary piston pump in accordance with claim 6, characterized in that the rotary piston (20) in the area of the polygon corners, as viewed in the peripheral direction, is rounded in a convex manner and interacts in a sealing manner in these areas with the inner peripheral surface (6) of the cylinder chamber (4), wherein the rotary piston (20) in the area of the polygon sides, as viewed in the peripheral direction, is concave.

8. Rotary piston pump in accordance with claim 1, characterized in that the surface (28) of the dividing slide (26), which is turned toward the rotary piston (20) is convex, as viewed in the direction of rotation.

9. Rotary piston pump in accordance with claim 1, characterized in that with the dosing device (80) a volume change from zero up to a maximum value, corresponding to the respective volume of the working chamber (24), can be carried out in a continuous manner.

10. Rotary piston pump in accordance with claim 1, characterized in that the dosing device (80) has an adjustable ventilation valve (90) by which outside air with a variable volume is drawn into the working chamber (24) which increases in volume behind the inlet (8), so that a dosing of the medium takes place by varying the volume ratio between the medium and the drawn air.

11. Rotary piston pump in accordance with claim 1, characterized in that the rotary piston (20) has, in its outer periphery (22), depressions for respectively receiving one particle of the medium consisting of a multitude of similar particles in that, in the working chamber (24), respectively only one defined number of particles is conveyed in a manner corresponding to the depressions present inside the area of the working chamber (24), wherein excess particles are held back by means of the dosing slide (82).

12. Rotary piston pump in accordance with claim 1, characterized in that the dividing slide (26) is always separated by a defined sealing gap from the outer peripheral surface (22) of the rotary piston (20).

* * * * *